United States Patent [19]

Zeuner et al.

[11] Patent Number: 4,865,667

[45] Date of Patent: Sep. 12, 1989

[54] GAS-GENERATING COMPOSITION

[75] Inventors: Siegfried Zeuner, Munich; Walter Holzinger, Deisenhofen, both of Fed. Rep. of Germany

[73] Assignee: Bayern-Chemie Gesellschaft für Flugchemische Antriebe mit beschränkter Haftung, Fed. Rep. of Germany

[21] Appl. No.: 252,520

[22] Filed: Sep. 30, 1988

[30] Foreign Application Priority Data

Oct. 1, 1987 [DE] Fed. Rep. of Germany ..... 3733177

[51] Int. Cl.[4] ..... C06B 93/00

[52] U.S. Cl. ..... 149/22; 149/42; 149/43; 149/61; 149/76; 149/77; 280/741

[58] Field of Search ..... 149/22, 42, 61, 43, 149/76, 77; 280/741

[56] References Cited

U.S. PATENT DOCUMENTS 4,376,002 3/1983 Utracki ..... 149/35

4,386,979 6/1983 Jackson ..... 149/61

*Primary Examiner*—Stephen J. Lechert, Jr.

*Attorney, Agent, or Firm*—Toren, McGeady & Associates

[57] ABSTRACT

A nitrogen-generating composition useful for inflating air bags to protection for occupants of motor vehicles is disclosed which is composed of a stable nitride resistant to high temperatures and an inorganic oxidizing agent.

14 Claims, No Drawings

GAS-GENERATING COMPOSITION

FIELD OF INVENTION

This invention concerns a gas-generating composition useful for inflating air bags for protection of occupants of motor vehicles. More particularly, this invention is directed to a gas-generating composition wherein no water or toxic substances are formed during the gas-generating reaction and wherein the solid components resulting from the reaction are in the form of a glassy slag.

BACKGROUND OF INVENTION

Air bags for protection of motor vehicle occupants must be inflated by the gas-generating composition within a fraction of a second, and they are generally constructed so that their gas content is released at a controlled rate. The propellant formed for such air bags must not contain any toxic components.

Alkali and alkaline earth metal azides in particular, which form nonpoisonous gas consisting essentially of nitrogen when reacted with an inorganic oxidizing agent, come into consideration as the gas supplying component of such compositions. Alkali and alkaline earth metal oxides, which form during oxidation, are relatively difficult to separate and may reach the interior of the vehicle. To make the oxide harmless, it is known, for example, from German Auslegeschrift 2,236,175, that silicon dioxide may be added to the gas-generating composition. The silicon dioxide and the alkali and alkaline earth metal oxides form a glassy slag, the separation of which presents no problems.

The composition disclosed by German Auslegeschrift 2,236,175, as used in practice, contains 56% sodium azide on a weight basis, a relatively high proportion. Moreover, sodium azide is highly toxic, comparable in this respect to potassium cyanide. Due to the constant increase in the number of motor vehicles which are equipped with such protection equipment, the disposal problems which arise when scrapping are appreciable. These problems result both from direct contamination of the environment, particularly soil and subterranean water with this highly toxic salt, and from the reaction of sodium azide on the scrap heap with acids. For example, sodium azide can come into contact with bacterial acids to form highly explosive heavy metal azides.

Therefore, every effort is made to reduce the azide content of such compositions or to make do without azides. For example, azide-free compositions based on solid rocket fuels have been disclosed in German Auslegeschriften 2,334,063 and 2,222,506. However, these compositions have a serious disadvantage; carbon monoxide and other toxic gases are formed from the carbon containing components thereof.

To avoid carbon monoxide formation, the use of oxygen-free oxidizers, such as chromium chloride, molybdenum disulfide or iron fluoride and tetrazoles as a nitrogen source has been disclosed in European Pat. No. 0,055,904. In these reactions, a propellant is formed which contains free metal, i.e. chromium, molybdenum or iron, and in some cases, substances which are even substantially more toxic, such as potassium cyanide. Furthermore, in view of the long time span over which an air bag must be usable, for example, more than ten years, the chemical stability of this composition leaves much to be desired.

Azide-free gas-generating compositions based on nitrides or an amine have been disclosed by German Offenlegungsschrift 2,407,659; these compositions generate gas by reacting according to the following equations:

$$Si_3N_4 + Na_3N + 3NH_4ClO_4 \longrightarrow 3SiO_2 + 3NaCl + 4N_2 + 6H_2O \quad (1)$$

$$Si_3N_4 + 6NaNH_2 + 6NH_4ClO_4 \longrightarrow 3SiO_2 + 6NaCl + 8N_2 + 18H_2O \quad (2)$$

$$Mg_3N_2 + NaClO_3 \longrightarrow NaCl + 3MgO + N_2 \quad (3)$$

$$Ca_3N_2 + KClO_4 \longrightarrow KCl + 3CaO + N_2 + \tfrac{1}{2}O_2 \quad (4)$$

The nitrides used, namely sodium nitride in reaction (1), magnesium nitride in reaction (3), calcium nitride in reaction (4) and sodium amide in reaction (2) are exceptionally reactive compounds. In fact, these compounds react especially vigorously with water, forming ammonia. Since the complete absence of water is practically unattainable with such a finely dispersed system, the stability of these known compositions is inadequate. At the same time, the decomposition of these known compositions with water leads to malodorous, toxic ammonia.

SUMMARY OF THE INVENTION

It is an object of the invention to provide a new azide-free gas-generating composition of high stability capable of forming an adequately large volume of nitrogen per unit volume of composition.

Another object of the invention is to provide a new azide-free gas-generating composition with high stability which, while forming an adequately large volume of nitrogen per unit volume of composition, leads to a physiologically safe propellant gas.

These and other objects are accomplished by the invention described below.

A gas-generating composition based on a nitride and an oxidizing agent has been discovered which fulfills the objects of the invention, according to which, the nitride is selected from at least member of the group consisting of boron nitride (BN), aluminum nitride (AlN), silicon nitride ($Si_3N_4$) and a transition metal nitride or a mixture thereof.

DETAILED DESCRIPTION OF INVENTION

The nitrides used in accordance with the invention are exceptionally stable, thermally and chemically, to an extent that they are also used as ceramic materials. It is surprising, therefore, that these inert materials can be caused to react under the conditions of temperature and pressure existing in an air bag generator housing with conventional oxidizing agents for gas-generating compositions, i.e. ammonium, alkali and alkaline earth metal nitrates and perchlorates.

The nitride used in the gas-generating composition of the invention is selected exclusively from boron nitride (BN), aluminum nitride (AlN), silicon nitride ($Si_3N_4$) and a transition metal nitride or a mixture thereof. As the transition metal nitride, preferably titanium nitride (TiN), zirconium nitride (ZrN), hafnium nitride (HfN), vanadium nitride (VN). niobium nitride (NbN), tantalum nitride (TaN), chromium nitride (CrN), dichromium nitride ($Cr_2N$) or a mixture of these nitrides is used.

When either chromium nitride or a mixture of boron nitride and chromium nitride is used as the nitride and potassium nitrate is the oxidizing agent, the reaction of these compositions of the invention proceed according to the following equations:

$$10CrN+6KNO_3 \rightarrow 3K_2O.5Cr_2O_3+8N_2+2626 \text{ kj/mole} \quad (5)$$

$$3BN+2CrN+3KBO_3 \rightarrow 3KNO_2.Cr_2O_3+4N_2+1168 \text{ KJ/mole} \quad (6)$$

As shown in equations (5) and (6), as a result of the gas-generating reaction of a composition of the invention, the total solid residue is bound in the form of $3K_2O.5Cr_2O_3$ or $3KBO_2.Cr_2O_3$, i.e., as a glassy slag. Moreover, nitrogen is formed exclusively as the propellant gas.

With respect to the nitrides, it is important to note that although the proportion of nitrogen on a weight basis is appreciably less in the nitrides used in the composition of the invention than in conventionally used sodium azide, the proportion on a volume basis is comparable. For example, the proportion of nitrogen by weight in sodium azide is 64.6%; by volume it is 1.2 normal liters/cc. For CrN, the proportion by weight is only 21.2%; however, the proportion by volume is 1.02 normal liters/cc.

It follows from the foregoing, for example, that the mixture illustrated in equation (5) forms only 0.14 normal liters of nitrogen per gram, as compared with about 0.31 normal liters of nitrogen per gram which are generated by the known composition disclosed by German Auslegeschrift 2,236,175, which contains sodium azide. However, the volume of gas formed by the reaction of equation (5) is 0.58 normal liters/cc. compared with 0.65 normal liters/cc. for the known composition. In other words, per unit volume of composition, the formation of nitrogen by a composition of the invention is approximately comparable to that of a conventional gas-generating composition containing sodium azide.

To ensure that the nitride bonds with the alkali metal, the nitride and oxidizing agent are used in stoichiometric ratios, as illustrated in equations (5) and (6). Further, to achieve defined reactive or oxidative properties, it may be advantageous to employ mixtures of nitrides used in accordance with the invention.

Any inorganic oxidizing agent may be used as the oxidizing agent in the compositions of the invention. However, for practical reasons, potassium nitrate is preferred, since, despite a relatively low decomposition temperature, it is comparatively stable, has a low hygroscopicity and moreover, is readily available.

If necessary, an ignition aid based on a metal powder-/oxidizing agent mixture may be added to the composition of the invention. As the metal powder, use may be made of boron, magnesium, aluminum, zirconium, titanium or silicon, for example. Examples of useful inorganic oxidizing agents include ammonium, alkali and alkaline earth metal nitrates and perchlorates.

The following example further illustrates the invention, but must not be considered to limit the invention in any manner.

EXAMPLE

A mixture of finely ground chromium nitride (CrN), potassium nitrate, and boron was prepared. The potassium nitrate was present in a stoichiometric amount such that it was adequate to oxidize the chromium nitride and boron completely. The mixture was compressed into tablets with a diameter of 6 mm. and a thickness of 2.5 mm. About 80 g. of the tablets were introduced into a conventional gas generator housing for an air bag, as described in German Patent No. 2,915,202 and ignited by means of an electrical igniter and a booster charge based on boron and potassium nitrate. The metal nitride is oxidized with release of the theoretical amount of nitrogen.

We claim:

1. A gas-generating composition useful for inflating air bags as protection for occupants of motor vehicles comprising fuel which is at least one nitride selected from a member of the group consisting of boron nitride, aluminum nitride, silicon nitride, a transition metal nitride or a mixture thereof and an inorganic oxidizing agent, wherein nitrogen is formed exclusively as the inflating gas when said fuel is oxidized by means of said oxidizing agent.

2. The gas-generating composition of claim 1 wherein the transition metal nitride is selected from a member of the group consisting of titanium nitride, zirconium nitride, hafnium nitride, vanadium nitride, niobium nitride, tantalum nitride, chromium nitride and a mixture thereof.

3. The gas-generating composition of claim 1 which additionally contains an ignition aid comprised of a mixture of metal powder and an oxidizing agent.

4. The gas-generating composition of claim 1, wherein the nitride and the inorganic oxidizing agent are present in about stoichiometric proportions.

5. The gas-generating composition of claim wherein the fuel is comprised of a mixture of nitrides.

6. The gas-generating composition of claim 1, wherein the oxidizing agent is potassium nitrate.

7. A gas-generating composition useful for inflating air bags as protection for occupants of motor vehicles comprising fuel and an inorganic oxidizing agent, wherein the fuel consists of at least one nitride selected from a member of the group consisting of boron nitride, aluminum nitride, silicon nitride, a transition metal nitride and a mixture thereof or at least one of said nitrides and an ignition aid of metal powder in combination with an oxidizing agent, wherein nitrogen is formed exclusively as the propellant when said fuel is oxidized by means of said oxidizing agent.

8. The gas-generating composition of claim 7, wherein the nitride and the inorganic oxidizing agent are present in about stoichiometric proportions.

9. The gas-generating composition of claim 7 wherein the fuel contains a mixture of nitrides.

10. The gas-generating composition of claim 7, wherein the oxidizing agent is potassium nitrate.

11. A gas-generating composition useful for inflating air bags as protection for occupants of motor vehicles consisting of fuel and an inorganic oxidizing agent, wherein the fuel is at least one nitride selected from a member of the group consisting of boron nitride, aluminum nitride, silicon nitride, a transition metal nitride and a mixture thereof or at least one of said nitrides in combination with an ignition aid of metal powder and an oxidizing agent.

12. The gas-generating composition of claim 11, wherein the nitride and the inorganic oxidizing agent are present in about stoichiometric proportions.

13. The gas-generating composition of claim 11, wherein the fuel contains a mixture of nitrides.

14. The gas-generating composition of claim 11, wherein the oxidizing agent is potassium nitrate.

* * * * *